United States Patent [19]

Gehly

[11] Patent Number: 4,617,619

[45] Date of Patent: Oct. 14, 1986

[54] REFLECTOR FOR MULTIPLE SOURCE LIGHTING FIXTURE

[75] Inventor: Joel C. Gehly, McKean, Pa.

[73] Assignee: American Sterilizer Company, Erie, Pa.

[21] Appl. No.: 783,379

[22] Filed: Oct. 2, 1985

[51] Int. Cl.[4] ..... A61G 13/00; F21V 33/00

[52] U.S. Cl. ..... 362/804; 362/282; 362/302; 362/294

[58] Field of Search ..... 362/804, 240, 241, 242, 362/282, 277, 346, 347, 302, 303, 235, 350, 243, 245, 246, 247, 248, 293

[56] References Cited

U.S. PATENT DOCUMENTS

| | | | |
|---|---|---|---|
| 2,124,432 | 7/1938 | Ross | 362/282 |
| 2,586,645 | 2/1952 | Girolami | 362/302 |
| 2,597,605 | 5/1952 | White | 362/282 |
| 3,927,313 | 12/1975 | Herold | 362/234 |
| 4,037,096 | 7/1977 | Bendgord | 362/294 |
| 4,288,844 | 9/1981 | Fisher | 362/804 |
| 4,404,620 | 9/1983 | Takahashi | 362/304 |
| 4,418,379 | 11/1983 | DeMarsh | 362/282 |
| 4,559,671 | 12/1985 | Andrews | 362/804 |

FOREIGN PATENT DOCUMENTS

| | | | |
|---|---|---|---|
| 1065976 | 6/1954 | France | 362/804 |

*Primary Examiner*—Carl Stuart Miller

*Attorney, Agent, or Firm*—Robert D. Yeager; Christine R. Ethridge

[57] ABSTRACT

An improvement suitable for incorporation into a lighting fixture having a plurality of light source means for emitting light rays and at least one reflector wherein the one reflector superposes the light source means in a partially circumscribing, radially spaced relationship about the axis of symmetry of the lighting fixture to receive light rays and to project them onto a work surface. The improvement is a second reflector in axial alignment with, and rotatably mounted about, the axis of symmetry. The second reflector is positioned beneath the light source means and has a plurality of distinct surface sections, each of the surface sections being associated with one of the light source means for receiving the light rays emitted therefrom and projecting the light rays onto the one reflector. Each surface section has two radially adjacent portions. One portion has a textured finish for diffusing the light rays and the other portion has a specular finish for intensifying the light rays. The second reflector can be rotated to selectively position either the textured portion or the specular portion beneath each light source means to permit selective adjustment of the pattern and intensity of light rays projected from the lighting fixture.

11 Claims, 3 Drawing Figures

REFLECTOR FOR MULTIPLE SOURCE LIGHTING FIXTURE

BACKGROUND OF THE INVENTION

1. Field of the Invention

The present invention relates to illumination apparatus and more particularly, to a multiple source lighting fixture having a multiple reflector optical system.

2. Description of the Prior Art

Prior approaches to providing adjustability in the intensity of illumination from a lighting fixture have generally relied on increasing either the wattage or the size of the light source or increasing the number of light sources in a single lighting fixture. For example, Herold U.S. Pat. No. 3,927,313 discloses a surgical lighting fixture having several individual light sources evenly arranged around a central axis.

A problem with conventional multiple source lightheads however, is that they produce multiple individual light beams which, in turn, produce multiple shadows when the beams are interrupted. Efforts to reduce shadow formation have been made. Brendgord et al. U.S. Pat. No. 4,037,096 which issued on July 19, 1977, discloses a single source lighthead used with a multiple reflector optical system. The light rays are directed by means of the multiple reflectors to approach the illuminated area in an angled relationship to the axis of symmetry of the lighting apparatus, rather than parallel to the axis. Because the light rays approach objects from all angles, they tend to travel around the object, thus, reducing shadow formation on the desired area.

Applicant's co-pending application for MULTIPLE SOURCE LIGHTING FIXTURE, Ser. No. 754,704, filed July 15, 1985 also addresses the problem of reducing multiple shadows.

In some applications, for example, cardiovascular surgery, a larger pattern of illumination is preferred. Single source lightheads do not provide both high intensity and a large pattern of illumination. To achieve the desired intensity, the pattern of illumination must be limited or the wattage of the bulb increased. To achieve a large pattern, the intensity is reduced. In Europe, the trend is to couple larger surgical lights to provide a larger illumination pattern with a smaller light of greater intensity to pinpoint a critical area.

Where one lighting fixture is used for a variety of applications, those requiring high intensity and those requiring a large pattern, the lighting fixture should be adjustable to accommodate different needs. Several commercially available lighting fixtures provide some adjustability by means of altering the position of the entire lighting fixture relative to the work surface or by means of complicated light source positioning. For example, by altering the distance between the light source and the reflector in the lighting fixture, the pattern size and intensity can be varied.

There is a need for a means of adjusting the intensity and pattern of illumination in a multiple light source lighting fixture to accommodate a variety of lighting applications. There is a further need to provide such an adjusting means which is simple to use and does not require moving the entire lighting fixture or the light sources.

SUMMARY OF THE INVENTION

The present invention provides an improvement in lighting fixtures which permits the pattern and intensity of illumination to be adjusted by rotating one of the reflectors in the lighting fixture. The improvement is suitable for incorporation within a lighting fixture having a plurality of light source means for emitting light rays and at least one reflector wherein the one reflector superposes the plurality of light source means in a partially circumscribing, radially spaced relationship about the axis of symmetry of the lighting fixture to receive the light rays and to project the light rays onto a work surface.

The improvement includes a second reflector in axial alignment with the axis of symmetry of the lighting fixture and positioned beneath the plurality of light source means. The second reflector, which is superposed and partially circumscribed by the one reflector, has a plurality of distinct surface sections, each of the surface sections being associated with a different one of the light source means for receiving light rays emitted from the one light source means with which the surface section is associated and projecting light rays onto the one reflector. Each surface section has at least two radially adjacent portions, one of the portions having a surface finished for diffusing the light rays projected therefrom and the other portion having a surface finished for intensifying the light rays projected therefrom. The second reflector is mounted for rotation about the axis of symmetry of the lighting fixture to selectively position either the diffusing portion or the intensifying portion of the surface sections beneath each light source means to permit selective adjustment of the pattern and intensity of light rays projected from the lighting fixture.

The diffusing portion preferably has a textured finish and the intensifying portion preferably has a specular finish. The surface area of the textured portion is preferably equal to or greater than the surface area of the specular portion. In an alternative embodiment, there may be more than two portions in each surface section wherein the radially adjacent portions within each surface section progress gradually from having a textured finish to at least one less textured finish to a specular finish.

There are preferably eight light source means, each being superposed and partially circumscribed by a source reflector which is positioned to receive the light rays emitted from the one light source means which such source reflector superposes and to project the light rays so received onto the second reflector. Each source reflector preferably includes a filter through which the reflected light rays pass before impinging the second reflector. In the embodiment of the lighting fixture having eight light source means there are eight surface sections arranged radially about the second reflector.

BRIEF DESCRIPTION OF THE DRAWINGS

The present invention can be better understood by reference to the drawings in which.

DETAILED DESCRIPTION OF THE PREFERRED EMBODIMENT

Figure 1:
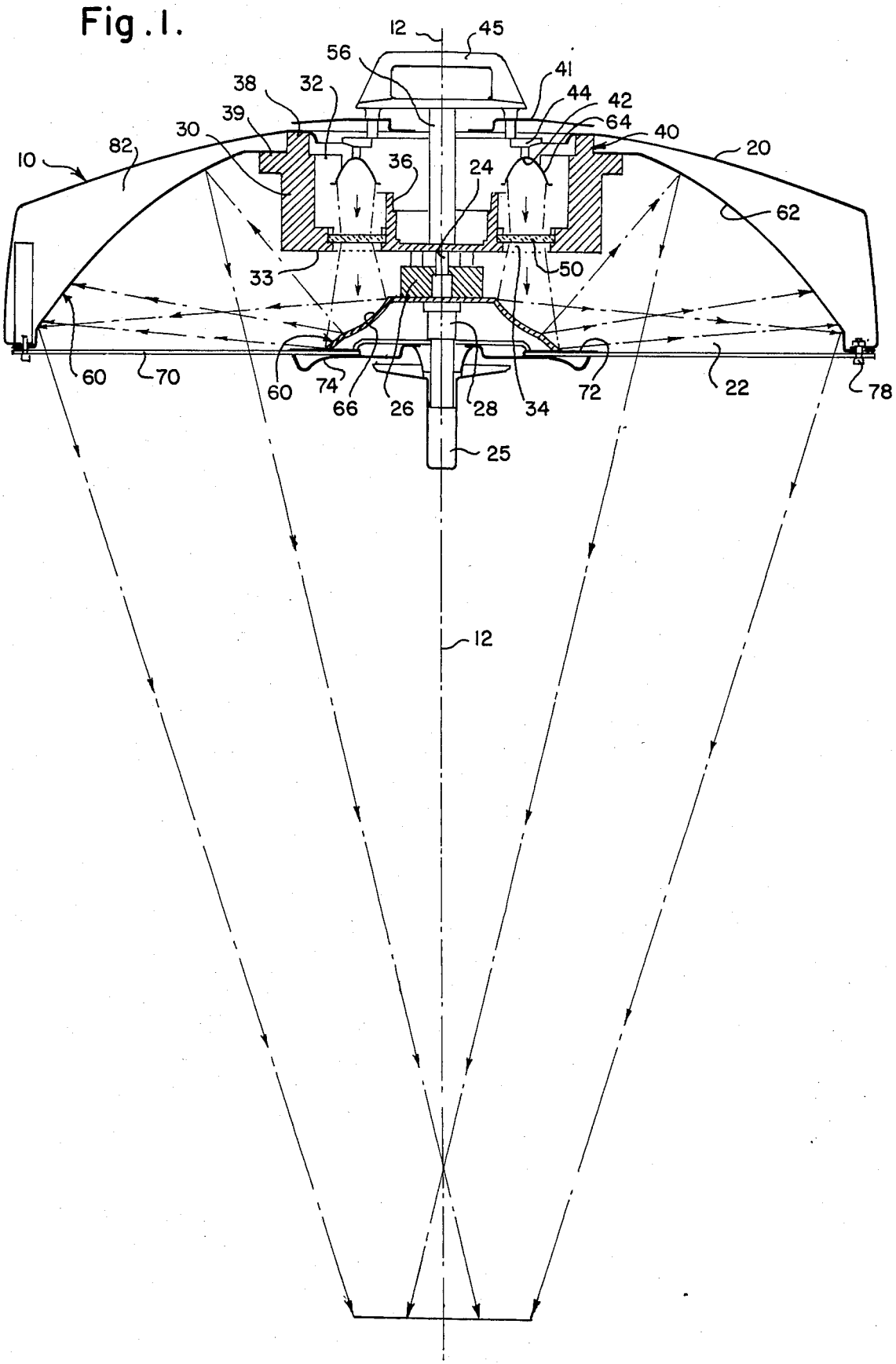
FIG. 1 is a side elevation section view of the preferred embodiment of the reflector of the present invention positioned in a lighting fixture.
Figure 2:
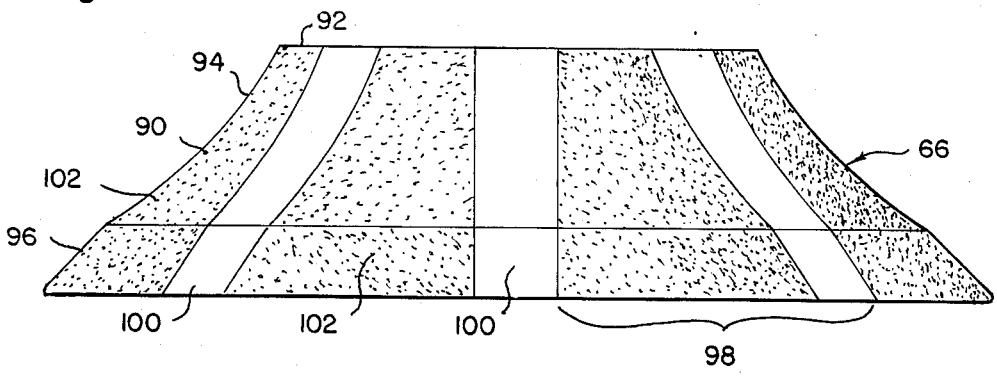
FIG. 2 is side elevation view of the reflector of FIG. 1.
Figure 3:
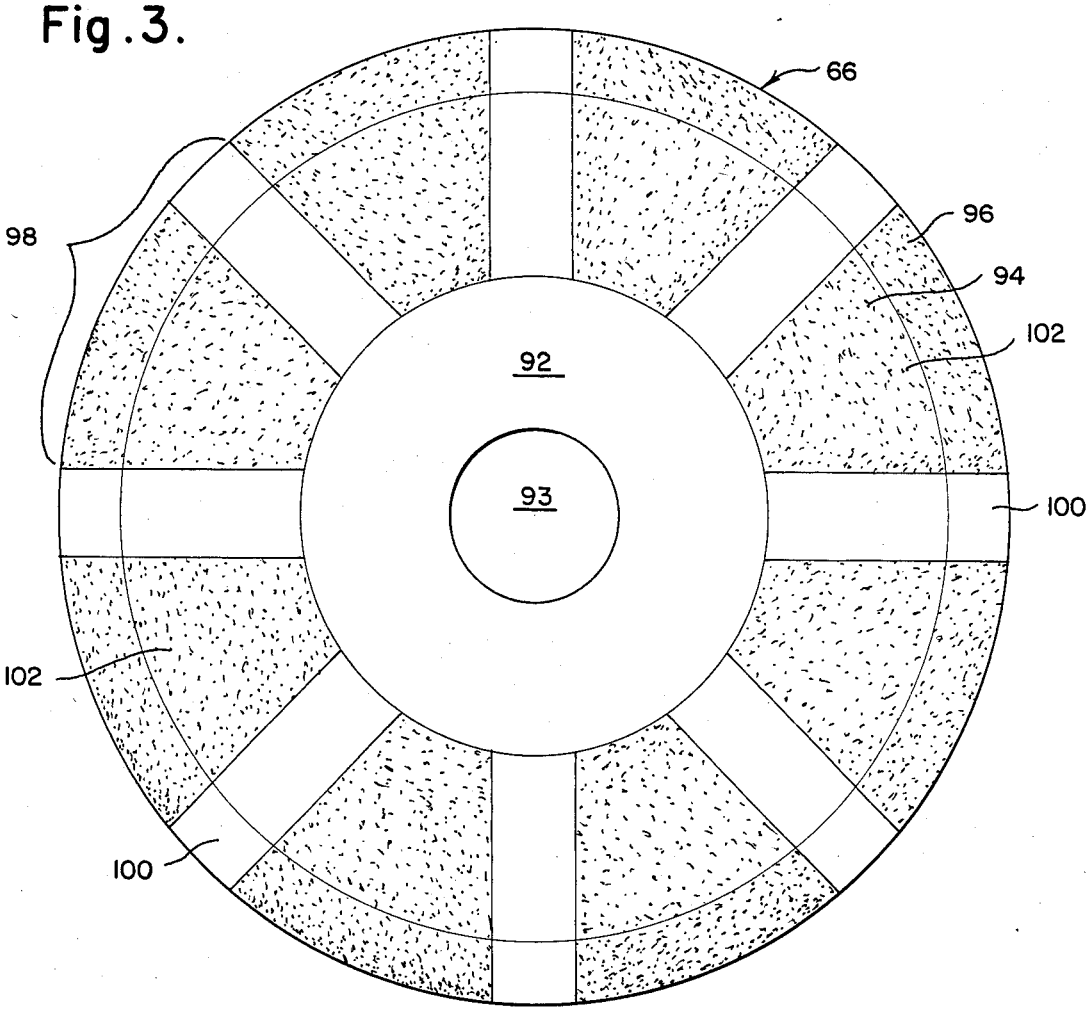
FIG. 3 is a top plan view of the reflector of FIG. 1.

FIGS. 1 through 3 illustrate the preferred embodiment of the lighting fixture 10 and reflector 66 of the present invention. Although lighting fixture 10 is shown as a surgical light, those skilled in the art will recognize that the improved means for adjusting the intensity and pattern of illumination can be used with any lighting fixture having multiple light sources and a suitable reflector system.

The preferred embodiment of lighting fixture 10 includes generally an outer shell 20, a lampholder assembly 40 and a reflector system 60. Lampholder assembly 40 includes a plurality of, preferably eight to twelve, tungsten halogen lamps, or light sources 42.

Each light source 42 is operatively associated with and held within a contiguous source reflector 64 and positioned over a filter 50 in openings 34 in housing 30. The multiple light sources 42 can be arranged in a relatively small area and each should be precisely located relative to its source reflector 64 to produce a precise light pattern. In a preferred embodiment, each source reflector 64 has a rim diameter of about two inches.

The lamp holder assembly 40 is positioned in housing 30 over an opening 22 in outer shell 20. The housing 30 is a cylindrical structure having outwardly extending radial ribs 32, a bottom 33 defining openings 34 and an inner annular member 36. There are preferably eight to twelve openings 34, one for each light source 42, arranged circumferentially around annular member 36. Portions 38 join housing 30 to outer shell 20 by means of a screw. Portions 39 join housing 30 to concave reflector 62, also by means of screws. Extensions from housing 30 support filter 50, together with suitable gaskets and a retaining ring (not shown) in each opening 34. A plate 44 holds lamp sockets 46 from which the source reflectors 64 and light sources 42 are suspended. The lamp holder assembly 40 also includes cover 41 and handle 45.

A bolt 24 extends through the bottom 33 of housing 30 to connect a guide 56 to block 26. A shaft 28 joins block 26 to a handle 25. A lens plate 72 and lower cover plate 74 sandwich lens 70 between them to support its central portion. Lens 70 is preferably a diffusion lens to add uniformity to the pattern of illumination. The outer edges of lens 70 are held by trim rings 78. Bolts join the trim rings 78, lens 70, concave reflector 62 and outer shell 20.

The reflector system 60 includes source reflectors 64, a uniquely configured, outwardly directing reflector 66 and a large outwardly spaced concave reflector 62. Each source reflector 64 preferably has "cold mirror" properties. The source reflectors 64 are preferably dichroic coated glass reflectors which aid in the removal of radiant infrared energy through the back of the lighting fixture 10. The filters 50 are preferably hot mirror coated rounded filters adapted for color correction. Additional heat is removed through vents in concave reflector 62. The heat escapes through the space 82 defined between outer shell 20 and concave reflector 62. Any suitable means of removing heat to the top of the lighting fixture 10, away from the surface to be illuminated can be employed.

Outwardly directing reflector 66 is positioned beneath housing 30 in axial alignment with the axis of symmetry 12 so that the light rays from the light sources 42 are directed through filters 50 onto the surface 90 of reflector 66. Surface 90 of reflector 66 includes an upper flat portion 92 having an opening 93 through which the shaft 28 passes. Surface 90 also includes a first curved portion 94 and a second portion 96.

The adjustability of the pattern and intensity of illumination is made possible by outwardly directing reflector 66 which is mounted for rotation about the axis of symmetry 12 by means of handle 25. Reflector 66 includes multiple distinct surface sections 98, preferably eight to twelve. There must be one such section positioned beneath each light source 42 to receive the light rays emitted from that light source.

In the embodiment shown, each surface section includes two radially adjacent portions 100 and 102, although more than two portions per surface section may be desirable in some applications. Each portion 100, 102 has a different surface finish. Portion 100 has a highly polished surface to provide a specular finish for intensifying light rays which strike that portion. Portion 102 has a textured finish for diffusing light rays which strike that portion.

The greater the texture, that is, the grittier the texture, the more diffusion of light is achieved, and consequently, the greater the pattern of illumination. The intensity of illumination, however, decreases. Depending upon the anticipated applications for a particular lighting fixture, and the patterns of illumination desired, the texture of portion 102 can be appropriately modified at the manufacturing level to accommodate a variety of applications. Similarly, the more highly polished the specular finish of portion 100, the more intense the light. Portion 100 can also be appropriately modified by the manufacturer to accommodate a variety of needs.

In some applications, it may be desirable to provide more than two portions within each surface section 98 to provide a greater variety of illumination options. For example, there may be a gradual, progressive increase in texture from a highly specular finish to a less specular finish to a slightly textured finish and so on to increasingly grittier finishes. Alternatively, there may be several distinct, and differently finished portions.

The surface area of the textured portion 102 is preferably equal to or greater than the surface area of the specular portion 100. In the preferred embodiment, the specular portion 100 is approximately $\frac{1}{2}$–$\frac{3}{4}$ inch wide.

Reflector 66 may be made of a high temperature plastic to tolerate the continuous heat of the lighting fixture 10. The plastic is preferably injection molded to achieve a very tight tolerance in surface dimension and consistently repeatable finish qualities from section to section and reflector to reflector. The reflector is then vacuum metalized with a highly pure aluminum base and a protective coating. Although aluminum is preferred, any suitable reflective material can be used.

By rotating reflector 66 about the axis of symmetry 12, the pattern and intensity of illumination can be selectively controlled. In an embodiment of lighting fixture 10 having eight light sources 42, the reflector 66 can be rotated about 22.5° to provide variations in between high and low intensity illumination and relatively small to large pattern sizes.

Referring to FIG. 1, light is directed from each light source 42 onto its integral source reflector 64. The rays are reflected downwardly through filters 50 so that the reflected light rays have a major directional component generally parallel to the axis of symmetry 12. The rays are thus directed onto the first and second surface portions 94 and 96, respectively, of surface 90 of reflector 66 and onto the portion 100 or 102 positioned to receive the light rays. The unique configuration of surface 90 disperses the rays outwardly onto reflector 62 at an improved angle which mixes the rays from the multiple light sources. The rays impinging upon reflector 62 are projected through lens 70 and approach the area to be illuminated in an angled relationship relative to the extended axis of symmetry 12 so that all of the rays would eventually intersect the extended axis 12 if uninterrupted by the surface to be illuminated. By angling the approach of the light rays shadow formation is reduced significantly when an object is introduced into the path of the rays. If the rays were to be directed parallel to the axis 12 from multiple light sources, multiple shadow formation would result when the multiple beams are interrupted.

The improved reflector 66 provides a means for adjusting the intensity and pattern of illumination which is easy to use and offers consistently repeatable performance from lighting fixure to lighting fixure. In addition, the multiple light sources 42 offer redundancy so that the loss of one light source 42 does not significantly interfere with the intensity of illumination or degrade the pattern. Even after a partial burnout, the pattern of illumination remains substantially, and preferably completely, unchanged.

What is claimed is:

1. In a lighting fixture having a plurality of light source means for emitting light rays and at least one reflector, said one reflector superposing said plurality of light source means in a partially circumscribing radially spaced relationship about the axis of symmetry of said lighting fixture to receive light rays and to project light rays, an improvement comprising:

a second reflector in axial alignment with the axis of symmetry of said lighting fixture, said second reflector being positioned beneath said plurality of light source means and being superposed and partially circumscribed by said one reflector;

said second reflector having a plurality of distinct surface sections, each said surface section being associated with a different one of said light source means for receiving light rays emitted from the one said light source means with which said surface section is associated and projecting light rays onto said one reflector, each said surface section having at least two radially adjacent portions, one said portion having a surface finished for diffusing the light rays projected therefrom and the other said portion having a surface finished for intensifying the light rays projected therefrom; and said second reflector being mounted for rotation about the axis of symmetry of said lighting fixture to selectively position either said diffusing portion or said intensifying portion of said surface sections beneath each said light source means to permit selective adjustment of the pattern and intensity of light rays projected from said lighting fixture.

2. The improvement recited in claim 1 wherein said diffusing portion has a textured finish and said intensifying portion has a specular finish.

3. The improvement recited in claim 2 wherein there are more than two said portions in each said surface section and said radially adjacent portions within each said surface section progress gradually from said textured finish to at least one less textured finish to said specular finish.

4. The improvement recited in claim 1 wherein the surface area of said diffusing portion is equal to or greater than the surface area of said intensifying portion.

5. The improvement recited in claim 1 wherein there are eight light source means arranged circumferentially about the axis of symmetry of said lighting fixture and eight surface sections arranged radially about said second reflector.

6. The improvement recited in claim 1 wherein each said light source means is superposed and partially circumscribed by a source reflector, each said source reflector being positioned to receive light rays emitted from the one of said light source means which such source reflector superposes and to reflect the light rays so received onto said second reflector.

7. The improvement recited in claim 6 further comprising:

a plurality of filters, each said filter being so positioned beneath a one said source reflector that the reflected light rays from the one said source reflector pass through said filter before impinging said second reflector.

8. The improvement recited in claim 1 wherein said second reflector has an annular upwardly concave curve.

9. A lighting fixure to illumination an underlying work surface comprising:

a plurality of light source means for emitting light rays, said plurality of light source means being arranged circumferentially around the axis of symmetry of the lighting fixure;

a reflector system for folding and mixing the emitted light rays to so project the light rays that the light rays converge at an acute angle relative to the axis of symmetry of the lighting fixture, such converging light rays providing a pattern of illumination on the work surface;

said reflector system including a plurality of first source reflectors, each said source reflector being operatively associated with one of said light source means and at least partially circumscribing the one of said light source means with which such source reflector is associated to receive light rays directly from the one said light source means and to reflect such light rays so that the reflected light rays have a major directional component generally parallel to the axis of symmetry of the lighting fixture;

a second reflector in axial alignment with the axis of symmetry of the lighting fixture, said second reflector being positioned beneath said plurality of source reflectors and configured to so receive the reflected light rays that the reflected light rays from each said source reflector partially overlap the adjacent reflected light rays from each said adjacent source reflector, and said second reflector being contoured to disperse such overlapping reflected light rays outwardly from the axis of symmetry of the lighting fixture;

said second reflector having a plurality of distinct surface sections, each of said surface section being associated with a different one of said light source means for receiving light rays emitted from the one of said light source means with which said surface section is associated, each said surface section having at least two radially adjacent portions, one said portion having a surface finished for diffusing the light rays and the other said portion having a surface finished for intensifying the light rays, said second reflector being mounted for rotation about the axis of symmetry to selectively position either said diffusing portions or said intensifying portions beneath each said light source means to permit selective adjustment of the pattern and intensity of the light rays projected from the lighting fixture; and a third reflector radially spaced from said first and second reflectors in axial alignment with the axis of symmetry of the lighting fixture, said third reflector at least partially circumscribing said plurality of first reflectors and said second reflector so that said third reflector receives the dispersed light rays from said second reflector and projects the dispersed light rays so that the dispersed light rays converge at said acute angle relative to the axis of symmetry of the lighting fixture to provide said pattern of illumination.

10. A lighting fixture as recited in claim 9 wherein said reflector includes a first curved surface and a second curved surface, said second curved surface having a greater diameter than said first curved surface.

11. A lighting fixture as recited in claim 10 wherein said first curved surface is an annular, generally upwardly concave surface having a lower edge from which said second curved surface radially extends in a generally outward and downward direction.

* * * * *